United States Patent [19]

Bando et al.

[11] 4,077,622

[45] Mar. 7, 1978

[54] APPARATUS AND METHOD FOR TRANSFERRING SOFT PANELS FROM CONVEYING SURFACE

[75] Inventors: Mitsuru Bando, Odawara; Shun Aoki, Kanagawa, both of Japan

[73] Assignee: Kubota, Ltd., Osaka, Japan

[21] Appl. No.: 749,898

[22] Filed: Dec. 13, 1976

[30] Foreign Application Priority Data

Dec. 12, 1975 Japan ..... 50-148592

[51] Int. Cl.[2] ..... B65H 29/68

[52] U.S. Cl. ..... 271/183; 271/190

[58] Field of Search ..... 271/190, 183; 214/6 DK; 198/469

[56] References Cited

U.S. PATENT DOCUMENTS

| | | | |
|---|---|---|---|
| 2,859,965 | 11/1958 | Pabst | 271/190 |
| 3,370,690 | 2/1968 | Seedorf | 198/469 |
| 3,768,807 | 10/1973 | Spengler | 271/190 |
| 3,912,253 | 10/1975 | Jarman | 214/6 DK |

*Primary Examiner*—Richard A. Schacher

*Attorney, Agent, or Firm*—Armstrong, Nikaido & Marmelstein

[57] ABSTRACT

An apparatus comprises an endless conveyor formed in its conveying surface with slit-like dropping openings for permitting soft panels to pass therethrough, suction means disposed above a downstream portion of the conveying surface to attract and halt a traveling soft panel on the conveying surface, and a table positioned close to and below the conveying surface in opposed relation to the suction means. When the soft panel is held to the suction means by suction, continuous travel of the conveyor surface causes the rear end of the halted panel to enter the dropping opening, permitting the panel to project from the rear side of the conveying surface with the advance of the dropping opening and to be transferred onto the table in its standby position therebelow.

5 Claims, 7 Drawing Figures

APPARATUS AND METHOD FOR TRANSFERRING SOFT PANELS FROM CONVEYING SURFACE

BACKGROUND OF THE INVENTION

When asbestos-cement roofing tiles are manufactured by a dry method, a dry mixture of asbestos and cement is placed on a belt conveyor in the form of a layer having a specified thickness, and the layer is thereafter subjected to the step of wetting with water, coloring step, compressing step, cutting step, etc., to obtain uncured or green panels having the shape of the roofing tiles.

At the terminal end of the belt conveyor, the green panels are transferred from the belt conveyor to a table as stacked in the form of a block of specified number of panels. The block is then spontaneously cured, sent into an autoclave for curing and dried to obtain asbestos-cement roofing tiles. Although the cured tiles are tough, the green panels prior to the spontaneous curing are very soft and extremely susceptible to impact and bending. Conventionally, the green panels are transferred from the belt conveyor onto the table directly by the hands of the worker but, when handled manually, the green panels are very prone to damage.

In order to overcome this problem, we have already provided a stacking device including a vertically movable inclined table and disposed at the terminal end of the belt conveyor. The table is adapted to receive the panels from the conveyor in such manner that every time a panel is transferred onto the table, the table is lowered by an amount corresponding to the thickness of the panel, permitting the next panel to be slidingly transferred from the conveyor onto the panel already retained on the table, whereby the panels are stacked on the table. Although the panels can be stacked accurately with use of this device, the operation still involves the following drawbacks.

Since the green panel has a great coefficient of friction, the inclined table must have a large angle of inclination so as to enable the green panel to slidingly fall onto the table from the belt conveyor, with the result that the downwardly sliding panel is liable to damage on striking a stopper at the table end. Further when sliding on the surface of the panels stacked on the table, the panel tends to deface the underlying green panel or to roughen the surface thereof, pilling the asbestos fibers incorporated in the panel.

Thus, it has been difficult to transfer soft panels, such as green roofing tiles, from the belt conveyor free of damage and deformation.

SUMMARY OF THE INVENTION

This invention relates to an apparatus and a method by which soft panels, such as uncured or green panels prepared for the manufacture of roofing tiles by a dry method, can be transferred from a belt conveyor onto a table and accurately stacked thereon free of damage or deformation.

According to this invention, a conveying surface is formed with slit-like dropping openings for permitting passage of soft panels therethrough and is provided with suction means disposed above the conveying surface and a horizontal table positioned below the conveying surface. When the soft panel on the conveying surface is temporarily halted and held to the suction means, continuous travel of the conveyor surface causes the rear end of the panel to enter the dropping opening, permitting the panel to fall onto the table below the conveying surface, whereby the soft panels can be transferred from the conveying surface onto the table and stacked thereon.

An object of this invention is to provide an apparatus and a method by which soft panels on a conveying surface are temporarily held out of travel, then passed at their rear ends through a dropping opening and transferred onto a table below the conveying surface one after another.

Another object of this invention is to provide an apparatus of the type described in which the table disposed below the conveying surface is lowered by an amount corresponding to the thickness of the soft panel every time one soft panel is stacked on the table so that the panels can be stacked one after another.

Another object of this invention is to provide an apparatus of the type described in which on the downstream side of the dropping opening, the conveying surface is inclined downward toward the upstream direction, permitting the panel to enter the opening and project from the rear side of the coveyor surface with minimized bending and deformation so that the panels can be stacked free of deformation or damage.

DETAILED DESCRIPTION OF THE INVENTION

Figure 1:
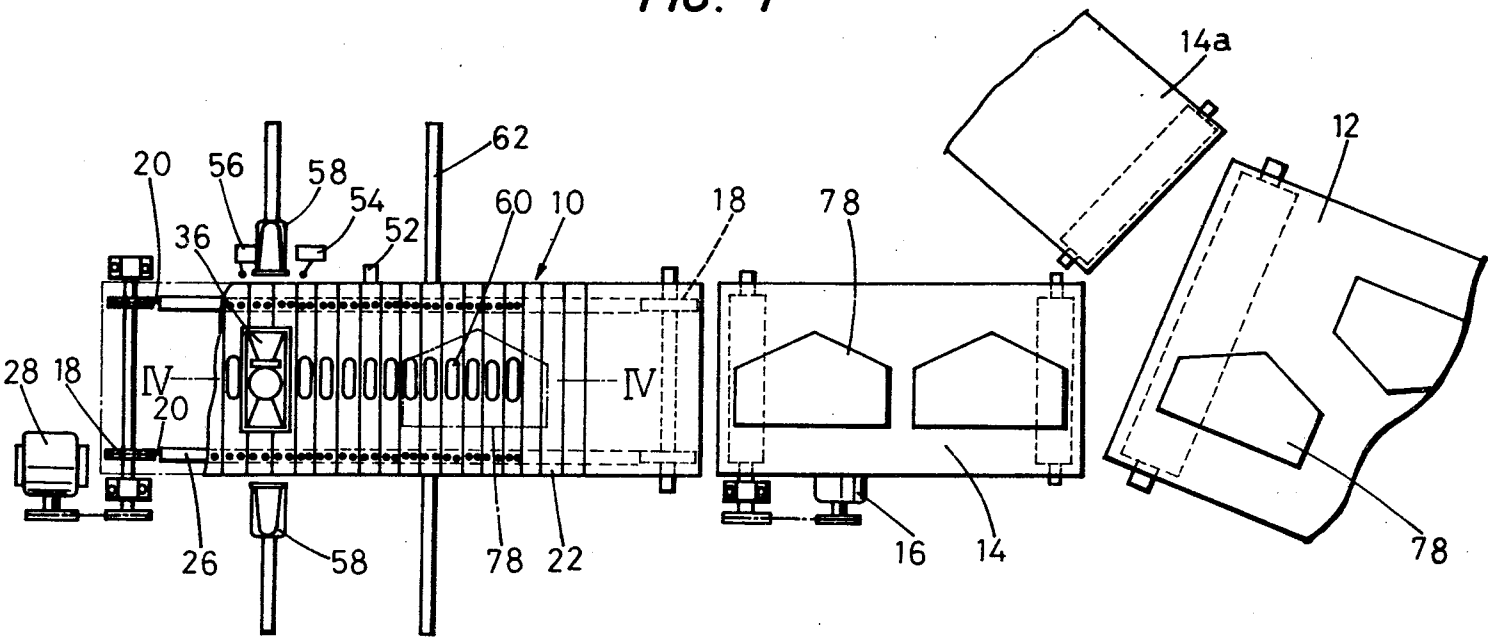
FIG. 1 is a plan view showing the layout of a transferring apparatus of this invention.
Figure 2:
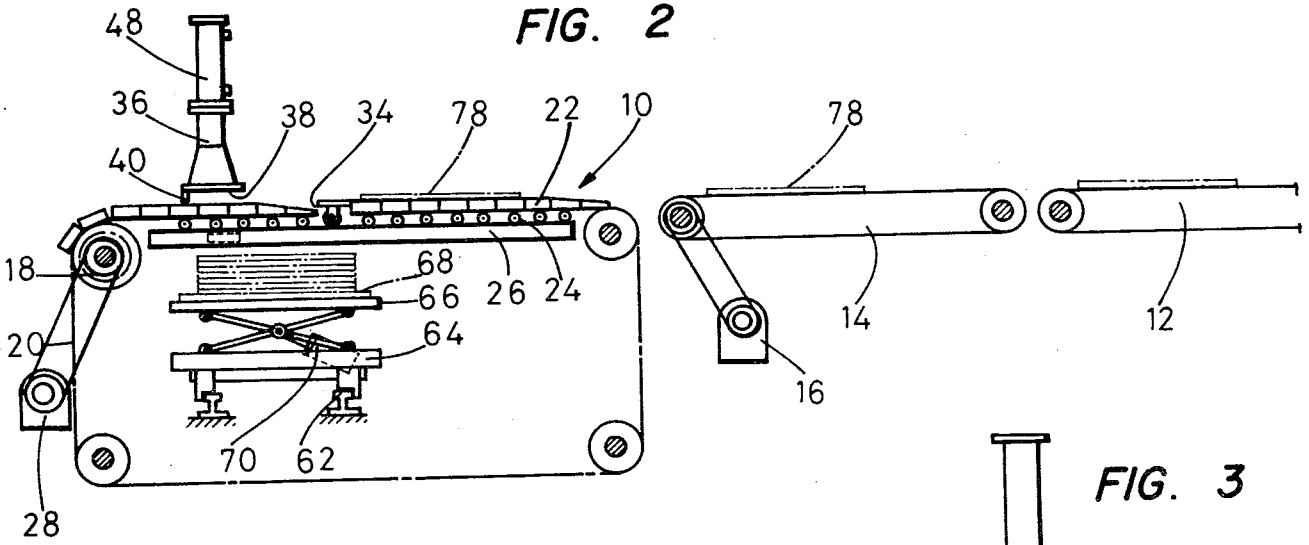
FIG. 2 is a front view of the apparatus.
Figure 3:
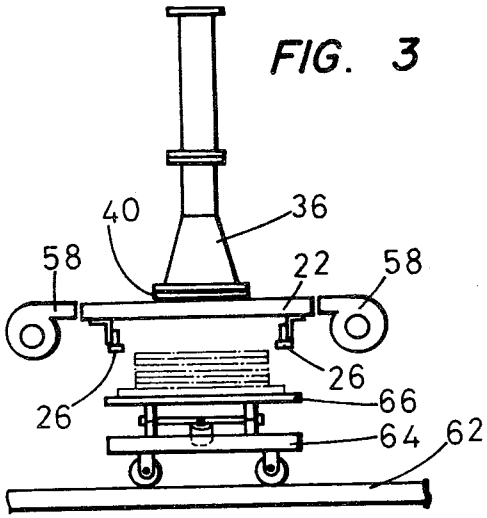
FIG. 3 is view in section taken along the line III—III in FIG. 1.

With reference to FIGS. 1 and 2, a transferring apparatus includes a transfer conveyor 10 having an endless conveying surface and disposed in alignment with each of branch conveyors 14, **14*a* arranged at the front end of a main conveyor 12. The main conveyor 12 carries soft panels 78 in two rows, which are transferred onto the branch conveyors 14, 14*a* as divided into the respective rows. The soft panels are further transferred to the transfer conveyor 10, from which a predetermined number of the panels are transferred onto a table 66 below the conveyor 10** and stacked thereon.

The speed of the branch conveyor 14 is controlled by speed change means 16 coupled to the drive roller of the conveyor 14 to send out the panels 78 onto the transfer conveyor 10 at a specified controlled rate in conformity with the speed of travel of the conveyor 10. The transfer conveyor 10, comprising endless chains 20 reeved around front and rear sprocket wheels 18, 18, is driven at a predetermined speed by a motor 28.

Extending between the chains 20, 20 are support pieces 22 of small width attached to the links of the chains respectively. Rails 26 are provided between the front and rear sprocket wheels 18, 18. Rollers 24 attached to the chain links or to the support pieces 22 are rollable on the rails 26 to support the support pieces 22 in a horizontal position. The conveying surfaces of the support pieces 22 are positioned within a horizontal plane. However, the support pieces include some slanting support pieces 30 spaced by a predetermined distance longitudinally of the chains 20 and having an upper surface progressively slanting downward toward the upstream direction of the conveyor. The support plates further include thin support pieces 32 adjacent the upstream ends of the slanting support pieces 30 and having a flat plate providing a conveying surface. A slit-like dropping opening 34 having a vertical width greater than the thickness of the soft panel 78 is defined by the rear of the slanting support piece 30 and the front end of the thin support piece 32.

The dropping opening 34 has a lateral width greater than the width of the soft panel 78. Accordingly, the soft panel 78 can slide over the upper surfaces of the support pieces 22, pass through the dropping opening 34 and project from the rear side of the conveying surface.

At a downstream portion of the transfer conveyor 10, suction means 36 is disposed above the conveying surface in opposed relaton thereto. The suction means 36 has at its lower portion a suction opening 38 spaced from the conveying surface by a distance corresponding to the thickness of the soft panel 78. A stopper 40 downwardly extends from a downstream end of the suction opening 38. The soft panel traveling on the conveying surface is temporarily brought to a halt by the stopper 40 on striking the stopper.

The suction means 36 includes at its upper portion a cylinder 42 formed in its one side a suction aperture 44 communicating with a tube connected to vacuum means.

Figure 5:
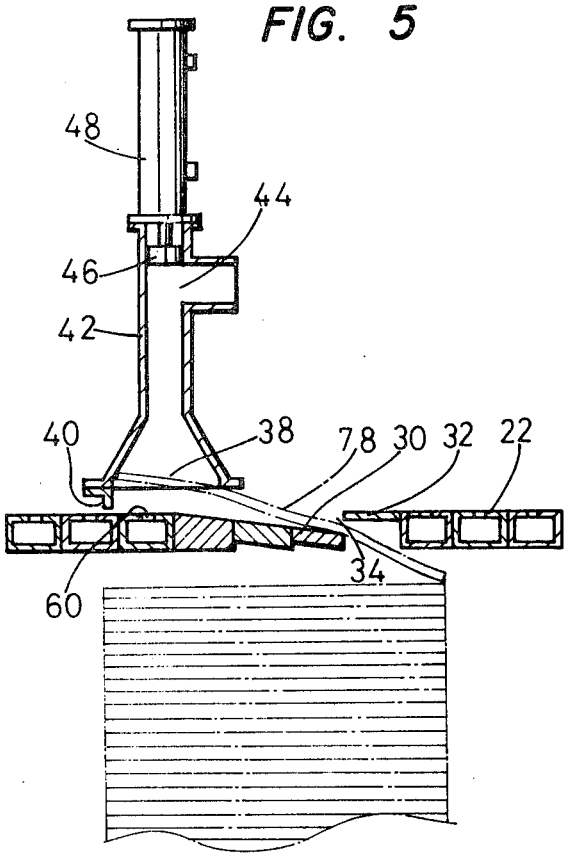
FIGS. 4 to 6 are views illustrating the steps by which soft panels are stacked on a table.
Figure 4:
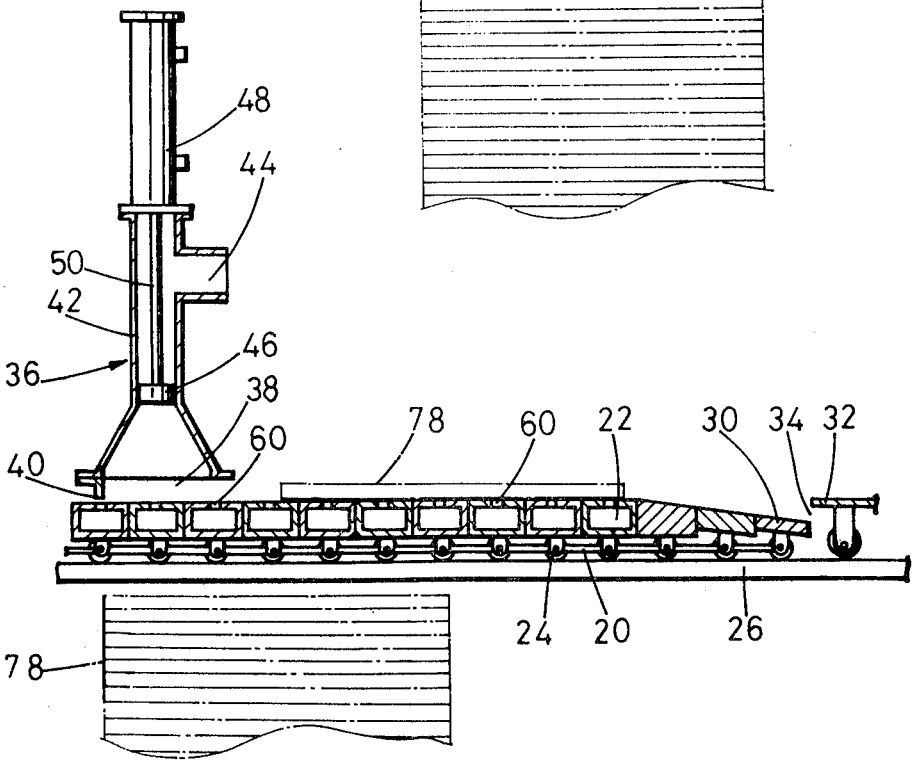

A closure 46 hermetically and slidably fits in the cylinder 42 and is connected to a piston rod 50 of valve means 48 mounted on the upper end of the cylinder 42, whereby the closure 46 is brought to either above or below the suction aperture 44 as seen in FIGS. 4 and 5. Thus, the closure serves as a valve element to cause a suction to act through the suction aperture 44 on the suction opening 38 in switching manner.

The transfer conveyor 10 is provided with an indicator 52, such as a projection, extending from one end of the thin support piece 32 defining the dropping opening 34, while in the vicinity of the suction means 36, the frame of the apparatus is equipped with first and second detectors 54, 56 for detecting the approach of the dropping opening 34 and the passage of the opening 34 below the suction opening 38 to switch the valve means 48.

The support piece 22 is in the form of a hollow tube which is open either at its opposite ends or at its one end. The piece 22 has an air outlet 60 in its upper surface. Disposed beside the suction means 36 is a blower 58 opposed to the path of travel of the ends of the support pieces 22, such that the blower 58 forces air to jet out from the outlets 60 of the support pieces 22.

Below the conveying surface upstream from the suction means 36, two rails 62, 62 are provided at right angles to the direction of travel of the transfer conveyor 10. A carrier 64 movable on the rails 62 is held in its stopped position below the transfer surface.

A table 66 upwardly and downwardly movable and connected to lifting means 70 is mounted on the carrier 64. The table 66 carries thereon a pallet 68 for receiving a stack of the soft panels 78.

Operation

The soft panels 78 sent out from the branch conveyor 14 are placed on the conveying surface provided by the support pieces 22 of the conveyor 10 and conveyed toward the suction means 36.

Since the branch conveyor 14 and the transfer conveyor 10 are driven at a speed controlled by the speed reduction means 16, the soft panels 78 are placed on the intermediate portion between the dropping openings 34 of the transfer conveyor 10 and will not be so transferred as to close the dropping opening 34.

When the soft panel 78 is away from the suction means 36, the closure 46 is in its lowered position as seen in FIG. 4, and the suction from the aperture 44 does not act on the suction opening 38.

When the indicator 52 passes by the first detector 54 with the approach of the soft panel 78 to the suction means 36, the valve means 48 is changed over, raising the closure 46 to above the suction aperture 44 as shown in FIG. 5 and producing suction at the opening 38. When the front end of the panel 78 reaches the opening 38, the panel 78 strikes the stopper 4 and is thereby halted. At the same time, the panel is attracted and held to the opening 38 by the suction.

However, with the continuous travel of the support pieces 22 at a low speed, the dropping opening 34 reaches the rear end of the panel 78, permitting the rear end of the panel 78 to slide on the surface of the slanting support piece 30 and enter the dropping opening 34 as seen in FIG. 5. Consequently, the panel 78 projects from the back side of the conveying surface, below which the carrier 64 is held in its standby position. Since the surface of the table 66 or the surface of the uppermost soft panel 78 stacked on the table 66 is located close to the back surfaces of the support pieces 22, the rear end of the panel 78 projecting from the back side of the conveying surface through the dropping opening 34 falls onto the top surface of the table 66 or of the stack of panels on the table. As the dropping opening 34 approaches the suction opening 38 with the continuous travel of the support pieces 22 driven by the chains 22, the amount of projection of the soft panel 78 increases, with the result that the panel 78 is transferred onto the top surface of the table 66 or the stack of panels thereon.

Figure 6:
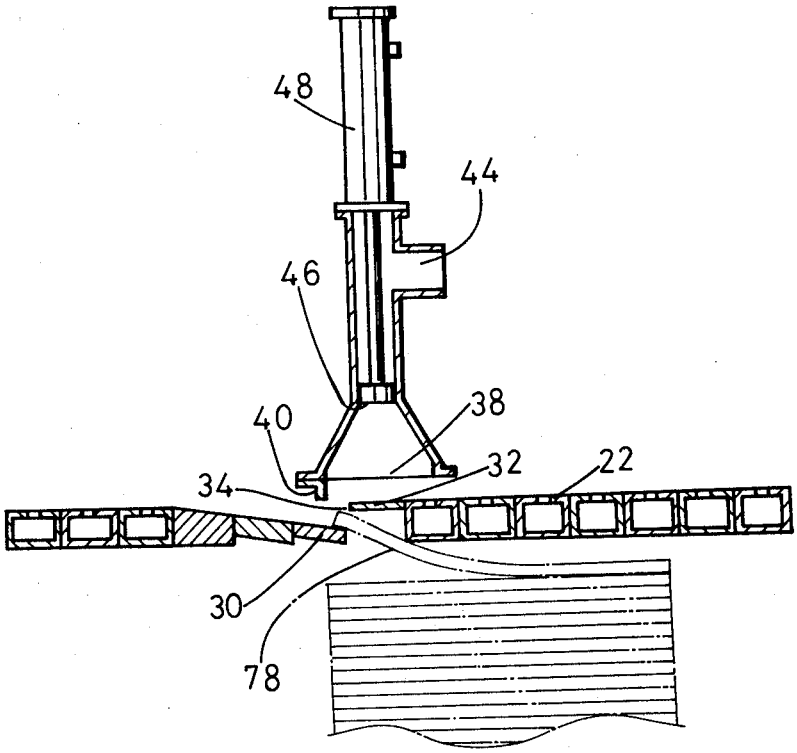

When the dropping opening 34 passes below the suction opening 38, the indicator 52 actuates the second detector 56, changing over the valve means 48 for the suction means 36 and thereby bringing the closure 46 to its lowered position below the suction aperture 44 as shown in FIG. 6. Consequently, the suction is eliminated from the opening 38, while the closure 46 moving in the cylinder 42 acts as a piston, forcing out air from the opening 38, whereupon the soft panel 78 which has been held attracted to the suction opening 38 is forced out of engagement with the opening 38 and transferred downward onto the table 66 or the panels stacked thereon (FIG. 6).

The soft panels 78 on the conveying surface can therefore be automatically transferred from the surface onto the table therebelow through the dropping opening 34 by virtue of the travel of the conveying surface without the necessity of using any manual labor. Moreover, since the panels are not subjected to impact or marked bending, they can be transferred and stacked almost free of any damage.

Because the soft panels can be stacked without involving any sliding contact with the surface of the underlying panel, entanglement or pilling of asbestos fibers can be eliminated which has heretofore been experienced due to such contact between the soft panels.

This ensures the manufacture of roofing tiles of good quality.

Figure 7:
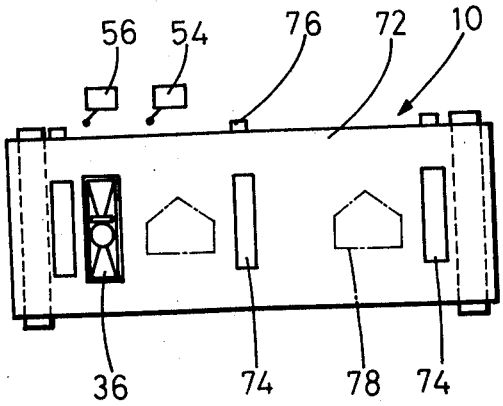
FIG. 7 is a plan view showing another embodiment of conveying means.

This invention is not limited to the embodiment described above with reference to the drawings. As illustrated in FIG. 7, for example, the transfer conveyor 10 may be in the form of an endless belt conveyor 72 which is provided with indicators 76 and slit-like dropping openings 74 at equal spacing so as to transfer soft panels from the belt conveyor onto a vertically movable table therebelow through the dropping openings 74. Thus, various modifications can be made without departing from the spirit of the present invention.

What we claim is:

1. An apparatus for transferring soft panesl from a conveying surface while the panels are being conveyed on the surface, the apparatus comprising endless conveyor means for conveying the soft panels, the conveyor means being formed with slit-like dropping openings extending therethrough from its front conveying surface to the rear surface thereof and permitting the passage of the soft panel therethrough, a carrier disposed below the conveyor means and having a table and lifting means for lowering the table in accordacne with the height of the panesl to be stacked thereon, and suction means disposed above the conveying surface in opposed relation to the carrier and having a suction opening facing the conveying surface with downward projecting means for stopping the progression of said panels disposed on the downstream side of said suction opening and valve means for effecting suction in switching manner.

2. An apparatus as defined in claim 1 wherein the endless conveyor means comprises a multiplicity of support pieces attached to endless chains, dropping openings are provided between support pieces for permitting passage of the soft panel.

3. An apparatus as defined in claim 1 wherein the conveyor means is provided with indicators arranged at the same spacing as the dropping openings, and means for detecting the passage of the indicators is disposed close to the suction means and opposed to the path of travel of the indicators, the detecting means being coupled to the valve means to effect suction by changing over the valve means when the indicator approaches the suction opening and to block the suction when the dropping opening passes below the suction opening.

4. An apparatus as defined in claim 1 wherein the conveyor means is a belt conveyor and the slit-like dropping openings are formed in its conveying surface.

5. A method of transferring soft panels from a conveying surface while the panels are being conveyed on endless conveyor means, the conveyor means being formed with slit-like dropping openings for permitting the passage of the soft panel therethrough, suction means being disposed at a downstream portion of the conveyor means with its suction opening positioned above the conveyor means, the method comprising stopping the progression of said panels at the downstream side of said suction means with a downwardly disposed stop attached to said suction means, producing suction at the suction opening to attract the front end of a soft panel by the suction and halt the panel when the soft panel approaches the suction opening, causing the rear end of the soft panel to pass through the dropping opening and project from the rear side of the conveyor means when the dropping opening passes over the rear end while the conveyor means continues to travel, progressively transferring the rearwardly projecting soft panel onto a table disposed below the conveyor means as the conveyor means further travels, and eliminating the suction on the dropping opening passing below the suction opening to allow the soft panel to fall onto the table and to be completely transferred onto the table.

* * * * *